US005094347A

United States Patent [19]

Schuster

[11] Patent Number: 5,094,347

[45] Date of Patent: Mar. 10, 1992

[54] WRAP-AROUND CARRIER WITH ARTICLE RETAINER

[75] Inventor: Richard D. Schuster, Monroe, La.

[73] Assignee: Riverwood Natural Resources Corporation, Denver, Colo.

[21] Appl. No.: 574,987

[22] Filed: Aug. 29, 1990

[51] Int. Cl.[5] ..... B65D 71/14

[52] U.S. Cl. ..... 206/434; 206/140

[58] Field of Search ..... 206/139-141, 206/145-147, 149, 156, 160, 161, 426, 427, 434; 229/40

[56] References Cited

U.S. PATENT DOCUMENTS

| | | | |
|---|---|---|---|
| 3,248,004 | 4/1966 | Weiss | 229/40 |
| 3,381,881 | 5/1968 | Ganz et al. | 229/40 |
| 3,424,302 | 1/1969 | Ganz | 229/40 |
| 4,164,286 | 8/1979 | Sutherland | 206/434 |
| 4,200,220 | 4/1980 | Ganz | 206/140 |
| 4,328,891 | 5/1982 | Elward | 229/40 |
| 4,373,630 | 2/1983 | Oliff | 229/40 |
| 4,421,232 | 12/1983 | Konaka | 206/157 |
| 4,574,997 | 3/1986 | Ikeda | 206/434 |
| 4,703,847 | 11/1987 | Oliff | 206/434 |
| 4,919,266 | 4/1990 | McIntosh et al. | 206/434 |
| 5,002,225 | 3/1991 | Bienaime | 206/140 |
| 5,031,770 | 7/1991 | Chaussadas | 206/434 |

*Primary Examiner*—Jimmy G. Foster

*Attorney, Agent, or Firm*—John Lister; Cornelius P. Quinn

[57] ABSTRACT

Integral retaining means in an open-ended wrap-around carrier for preventing articles such as bottles from escaping the carrier through the open end. The bottom panel is comprised of inner and outer mechanically connected flaps. The outer bottom panel flap contains a retainer flap at each end connected along a fold line which is generally parallel to the open end edge of the bottom panel. The retainer flaps extend up into the interior of the carrier through openings in the inner bottom panel flap. The retainer flap is folded along converging fold lines so that it forms a retainer finger engaging the outer portions of the end bottles in two adjacent rows of bottles in the carrier.

17 Claims, 4 Drawing Sheets

FIG. 1
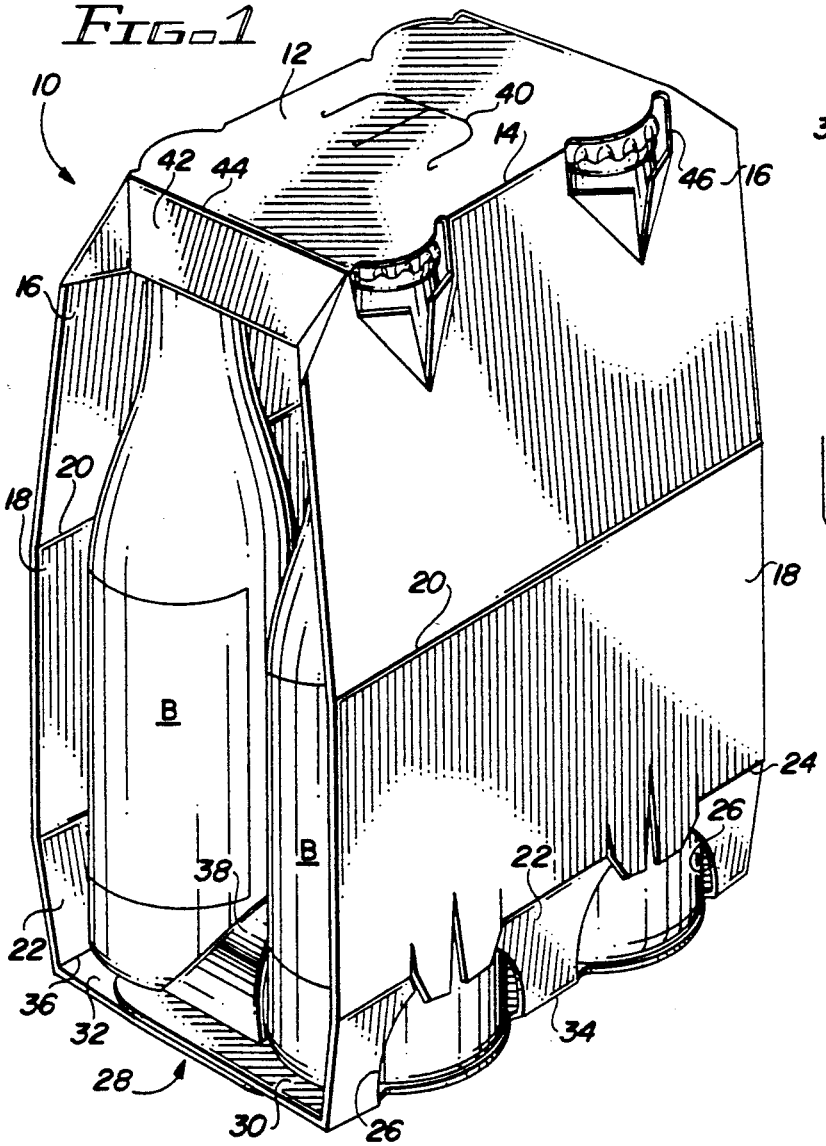
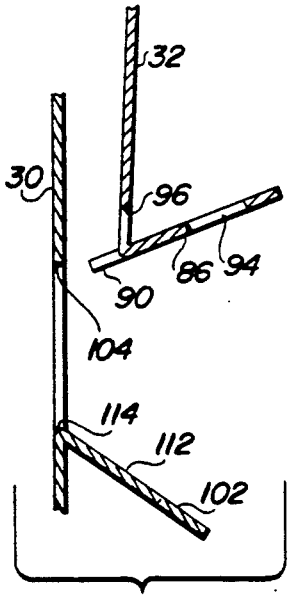
FIG. 5
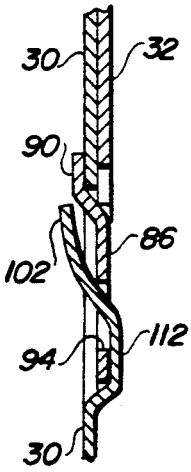
FIG. 7
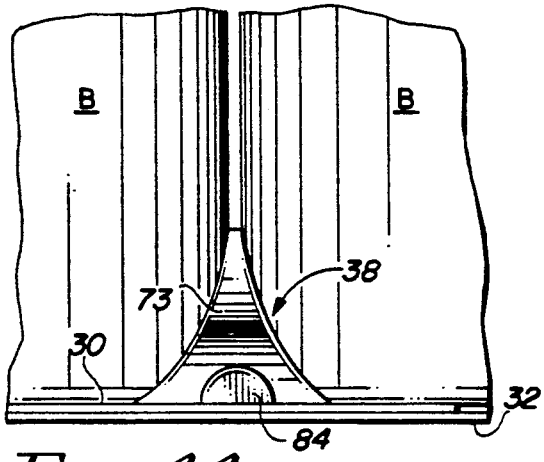
FIG. 11
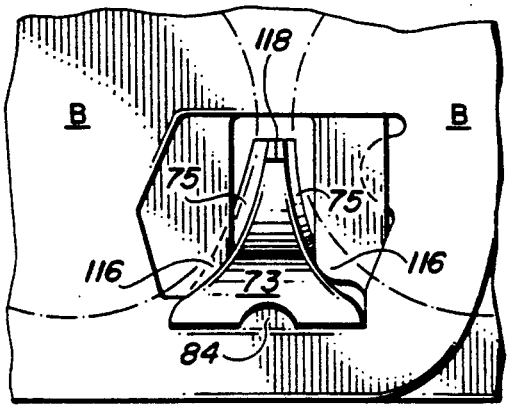
FIG. 12

WRAP-AROUND CARRIER WITH ARTICLE RETAINER

FIELD OF THE INVENTION

This invention relates to article carriers and, more particularly, to article carriers having at least partially open ends.

BACKGROUND OF THE INVENTION

Wrap-around article carriers are commonly designed to have ends which are either partially or entirely open. In either case the carriers must be provided with means for preventing the articles from falling out the ends. Beverage cans, for example, are held in place partly by the tension applied by the carrier blank being wrapped very tightly about them and by the engagement of the top and bottom flanges of the cans with the edges of cutouts in the side panels of the carrier through which the flanges of the can extend. This design is facilitated by the fact that cans have substantially flat tops and bottoms which are of substantially the same diameter as the body of the can. Even if, despite these design precautions, the cans are somehow dislodged and fall out the end of a carrier, the potential damage to the cans and to people in the vicinity of the accident is minimal, since the cans will normally remain intact, suffering no more damage than perhaps some dents or depressions.

Bottles are more difficult to retain in open-ended carriers than cans due to their shape. Even though cutouts may be provided in the side panels of a carrier to receive the heel portions of bottles, the variable contour of bottles due to their tapered or necked configuration makes it difficult to apply the carrier wrapper as tightly as in the case of cans. The problem is further magnified by the fact that for reasons of safety there is an even greater need to prevent bottles from escaping from their carrier due to the greater potential hazard resulting from broken glass and spilled beverage.

This problem has been recognized in the past, resulting in a number of different ways of retaining bottles in place. Openings are often provided in the top panel of a carrier through which bottle necks extend, and bottle neck retainer flaps or tabs are sometimes provided in conjunction with the openings to hold the bottle necks more firmly in place. In addition, partial end panels extending down from the top panel are sometimes provided. These features, however, do not prevent movement of the bottoms of the bottles out the open ends of the carrier. Moreover, due to the comparative slack fit of bottle wrappers compared to the tight fit of can wrappers, heel cutouts cannot be relied on to prevent the bottoms of bottles from moving toward the end of the carrier when subjected to the severe forces often encountered in use.

Partial end panels extending up from the bottom panel have been provided to function as bottle retainers, as have corner end gusset panels or flaps. These measures are not entirely satisfactory, however, because they require extra material to be used, making the carrier more costly to produce. Moreover, the extra retention provided by corner gusset panels is primarily adjacent the side panels, where retention means in the form of heel cutouts normally already exist. What is needed is a retention means which is effective for portions of bottles remote from the side panels of a carrier, such as adjacent portions of the end bottles in adjacent rows of bottles. It would also be advantageous if the retention means does not require the carrier blank to be larger than normal.

BRIEF SUMMARY OF THE INVENTION

In accordance with the invention, a wrap-around carrier having a top panel and side panels is provided with a bottom panel comprised of overlapping inner and outer bottom panel flaps. The inner bottom panel flap contains an opening adjacent an end of the carrier, and the outer bottom panel flap includes an integral article retaining means which extends through the opening into the interior of the carrier, where it engages the bottom portions of adjacent end articles of adjacent rows of articles and prevents outward movement of the articles.

In a preferred form of the invention the retaining means comprises a retaining flap connected to the outer bottom panel flap along a fold line which is substantially parallel to the end of the carrier. In addition, the retaining flap includes a fold line extending transversely of the fold line which connects the retaining flap to the outer bottom panel flap. Preferably, the transverse fold line takes the form of two fold lines extending from spaced points on the retaining flap fold line and converging toward each other. The opening in the inner bottom panel flap preferably includes openings at right angles to each other in order to receive the retaining flap as it moves into place and to accommodate the shape of the retaining flap after it has been folded along the transverse fold lines.

The resulting retaining flap is three dimensional, having an end face directed toward the end panel and side faces extending between adjacent end bottles. The transverse fold lines of the retaining flap are normally shaped so that the side faces of the flap are contoured to the shape of the bottom portions of the adjacent end bottles. Thus they may be curved when the bottoms of the articles are curved or angled when the article bottoms are straight. In this manner the retaining flap fits snugly between the spaced bottom portions of the end bottles and holds them in place against outward movement.

In addition to the retaining flap holding the bottom portions of the end bottles in place, it also functions to interconnect the inner and outer bottom panel flaps, thus providing reinforcement to any other locking means interconnecting the bottom panel flaps.

The above and other aspects of the invention, as well as other benefits, will readily be apparent from the more detailed description of the preferred embodiment which follows.

BRIEF DESCRIPTION OF THE DRAWINGS

FIG. 1 is a pictorial view of a wrap-around carrier incorporating the bottle retaining means of the present invention;

FIG. 5 is a transverse sectional view taken on line 5—5 of FIG. 4;

FIG. 7 is a transverse sectional view taken on line 7—7 of FIG. 6;

FIG. 11 is an enlarged partial end view of the carrier of FIG. 1, showing the retainer flap and its relationship to the adjacent end bottles in more detail; and FIG. 12 is a partial plan view of the retainer flap shown in FIG. 11, with the bottles shown in phantom.

DETAILED DESCRIPTION OF THE PREFERRED EMBODIMENT

Figure 2:
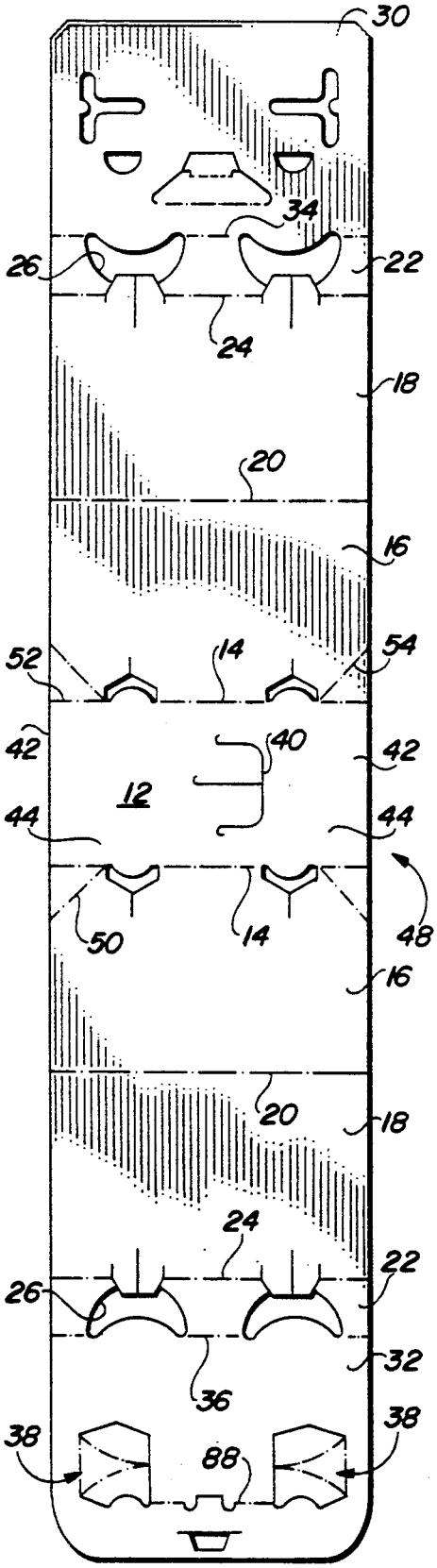
FIG. 2 is a plan view of a blank for forming the carrier of FIG. 1.

Referring to FIG. 1, a wrap-around carrier 10 comprises a top panel 12 connected along fold lines 14 to angled upper side panels 16 which generally follow the contour of the tapered neck portions of packaged bottles B. Intermediate side panels 18 are connected to the angled side panels 16 along fold lines 20 and to short angled lower side panels 22 along fold lines 24. The angled lower side panels 22 make it possible for the heel portions of the bottles to extend through heel cutouts 26 in the lower side panels 22. A bottom panel 28 is formed by overlapped inner and outer bottom panel flaps 30 and 32. The inner bottom panel flap 30 is connected to one of the angled lower side panels 22 along fold line 34 while the outer bottom panel flap 32 is connected to the other angled lower side panel 22 along fold line 36. Extending up from the bottom panel 28 adjacent the end bottles B in the adjacent rows of bottles in the carrier is a retainer flap 38, the details of which are described more fully below.

In addition to the features described thus far, the top panel 12 contains slits 40 which provide a handle for the carrier. The carrier is further illustrated as having short partial upper end panels 42 connected to the top panel 12 along fold lines 44. Also, the angled upper side panels 16 contain cutouts 46 through which upper portions of the bottles B, including portions of the bottle caps, extend. It will be understood that the handle need not be limited to the type illustrated, nor does the carrier have to be provided with partial end panels. Further, the top panel could just as well be provided with neck openings for receiving the necks of the bottles B, instead of the angled upper side panels being provided with the cutouts 16, without affecting the functioning of the invention.

As shown in FIG. 2, wherein like reference numerals to those used in FIG. 1 denote like elements, a blank for forming the carrier 10 comprises a substantially rectangular sheet 48 of paperboard or other suitable material, with the top panel section 12 being in the center of the sheet and the other panel sections described above being successively connected along the fold lines referred to above. The partial upper end panels 42 are connected to the side panels 16 by tuck flaps 50, which are connected to the partial end panels along fold lines 52 and to the angled upper panels 16 along fold lines 54.

Figure 3:
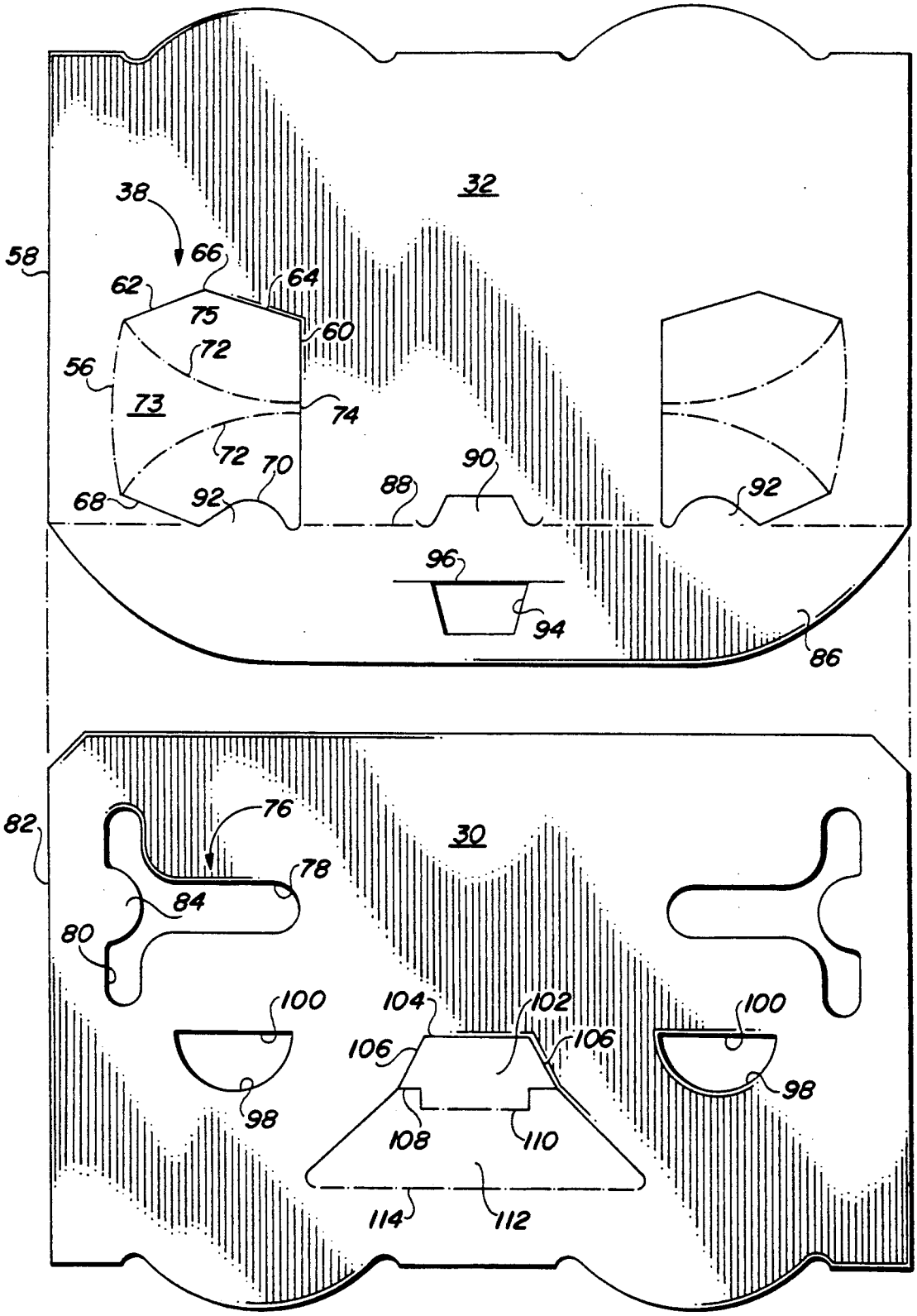
FIG. 3 is an enlarged plan view of the inner and outer bottom panel flaps just prior to being moved into overlapped condition.

In order to form a carrier from the blank 48, the blank is wrapped around the bottles or other articles to be packaged with the inner and outer bottom panel flaps 30 and 32 in overlapping relationship. The bottom panel flaps 30 and 32 are shown in FIG. 3 as they would appear after being folded in from lower angled side panels 22 about the fold lines 34 and 36 just prior to being moved into overlapping relationship. Still referring to FIG. 2, and also to FIG. 3, the retainer flaps 38 are connected to the outer bottom panel flap 32 along fold lines 56 which are spaced inwardly from the end edges 58 of the flap 32. Although generally parallel to the end edges 58, the fold lines 56 are preferably very slightly curved away from the nearest end edge 58 for a reason to be made clear hereinafter. A slit 60 substantially parallel to the end edges 58 of the outer bottom panel flap 32 forms the opposite edge of the retainer flap 38. One side of the retainer flap is defined by angled slits 62 and 64 extending from the interior ends of the fold line 56 and the slit 60, respectively, and intersecting at a point 66. The other side of the retainer flap is defined by an angled slit 68 extending from the outer end of the fold line 56, similar to the angled slit 62, and by a curved slit 70 connecting the slit 68 and the outer end of the slit 60. The retainer flap 38 further includes two arcuate fold lines 72 which extend from the ends of the fold line 56 and converge toward an interior point 74 on the opposite slit 60 to divide the retainer flap into three sections, a main body section 73 and two side sections 75.

The inner bottom panel flap 30 includes two generally T-shaped openings or slots 76 located so as to be aligned with the retainer flaps 38 when the inner and outer bottom panel flaps are arranged to form the bottom panel of the carrier. Each slot 76 comprises an elongated slot portion 78 extending from a transverse slot portion 80. The slot 80 is substantially parallel to and spaced from the nearest panel end edge 82 while the slot 78 extends at substantially right angles from the midpoint of the slot 80. The edge of the slot nearest the adjacent end edge 82 is curved at the central portion thereof to form an extension or tab 84 for a purpose to be described later.

Still referring to FIGS. 2 and 3, the bottom panel flaps are designed to be mechanically connected in a manner generally known in the prior art. The outer bottom panel flap 32 is connected to an end margin flap 86 along fold line 88. The fold line 88 is interrupted in the central portion by a slit defining a male locking tab 90 and on either side of the tab 90 by slits defining male locking tabs 92. The slit defining the locking tabs 92 is common to the curved slit 70 which defines the curved side portions of the retaining flaps 38. The margin flap 86 also contains a centrally located locking opening 94 the interior edge of which comprises a slit 96 which extends a substantial distance beyond the side edges of the opening.

The inner bottom panel flap 30 contains two locking openings 98 having edges 100 adapted to be engaged by the male locking tabs 92. In addition, the flap 30 contains a centrally located male locking tab 102 defined by end slit 104, side slits 106, angled slits 108 which form a neck portion, and fold line 110. The locking tab 102 is part of a larger tab 112 which is connected to the inner bottom flap 30 along fold line 114.

Figure 4:
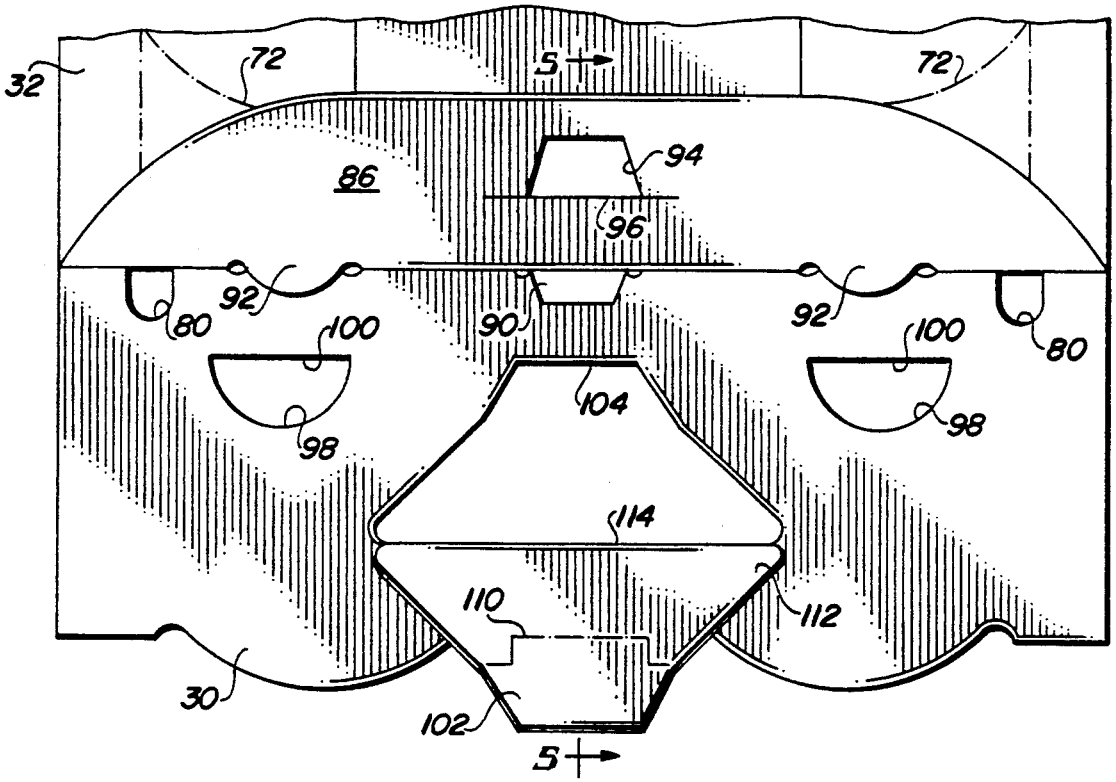
FIG. 4 is an enlarged plan view of the inner and outer bottom panel flaps in overlapped condition, with locking flap portions shown in an intermediate stage of the locking process.

To lock the bottom panel flaps together, they are positioned in overlying relationship, with the end margin flap 86 of the outer bottom panel flap and the tab 112 of the inner bottom panel flap being folded back as illustrated in FIGS. 4 and 5. The outer flap 32 is then moved to align the locking tabs 90 and 92 of the margin 86 with the locking edges 104 and 100, respectively, of the inner bottom flap 30. By folding the margin flap 86 back to its original position the locking tabs engage the locking edges and the underside of the inner bottom panel flap 30 to mechanically hold the bottom panel flaps together as the primary lock of the bottom panel. The tab 112 is then folded back to its original position and the locking tab 102 is folded about its fold line into the locking opening 94 through the slit 96 to effect a secondary lock. This arrangement is illustrated in FIGS. 6 and 7.

Figure 8:
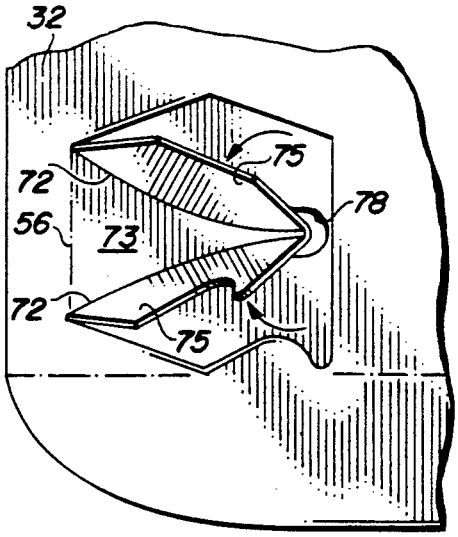
FIG. 8 is a partial plan view of the bottom panel of the carrier, showing the retainer flap in an intermediate position as it is being inserted into the associated opening in the inner bottom panel flap.
Figure 9:
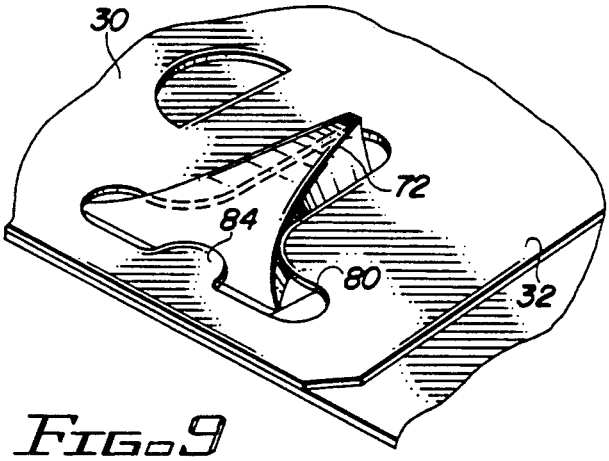
FIG. 9 is a partial pictorial view of the inner surface of the bottom panel of the carrier, showing the retainer flap in the intermediate position of FIG. 8, with the bottles omitted for the sake of clarity.
Figure 6:
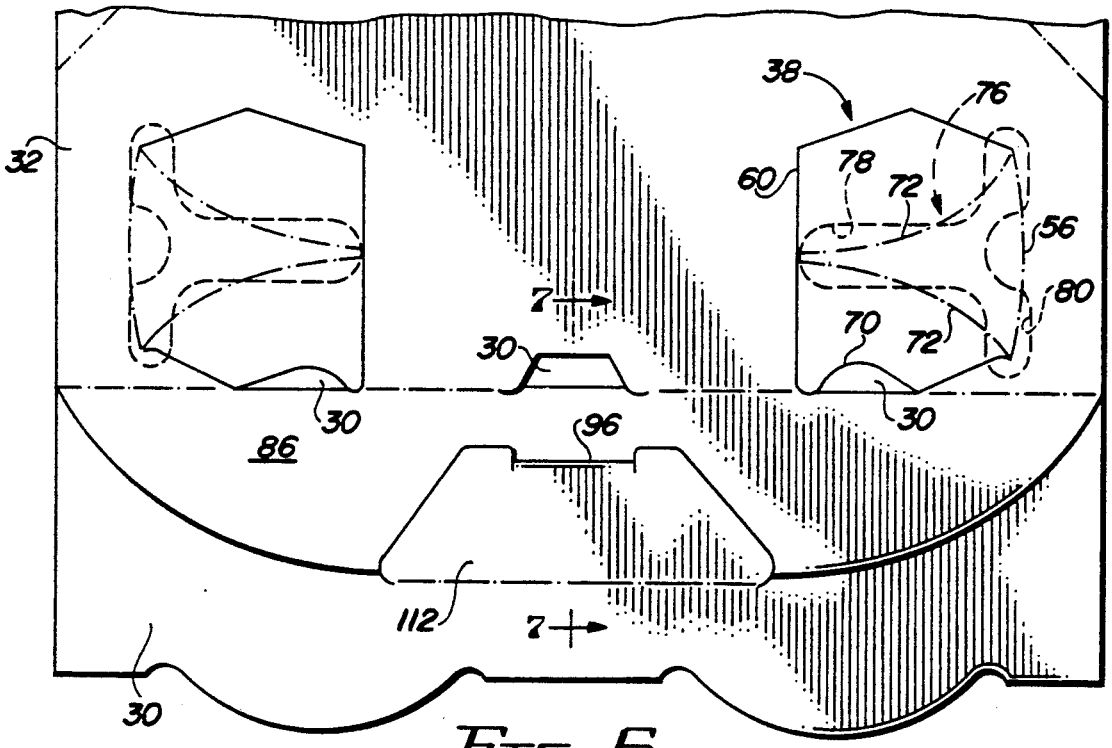
FIG. 6 is a plan view similar to that of FIG. 4, but showing the inner and outer bottom panel flaps in locked condition.

It can be seen in FIG. 6 that when the bottom panel flaps are locked together, the retainer flaps 38 are positioned directly over the T-shaped openings or slots 76. Pressure exerted on the main body sections 73 of the retainer flaps by an externally located movable punch or rod element, not shown but which will be understood by those skilled in the art preferably to be an operating element in an automatic packaging machine, will cause the retainer flaps to be pivoted up about their fold lines 56 and pushed up into the interior of the carrier through the T-shaped openings 76 in the inner bottom panel flap 30. A typical intermediate position of the retaining flap as it would appear during this movement is illustrated in FIG. 8, which shows the bottom of the retaining flap, and in FIG. 9, which shows the upper portion of the retaining flap as it emerges into the interior of the carrier. It will be seen that movement of the retainer flaps through the T-shaped slot in this manner causes the side retainer sections 75 to fold about their curved fold lines 72 as a result of their engagement with the edges of the elongated slot portions 78. It will also be seen that the retaining flap adjacent its fold line 56 moves up through the slot portion 80, bending the tab 84 up as the retaining flap continues to move up through the slot portion 80.

Figure 10:
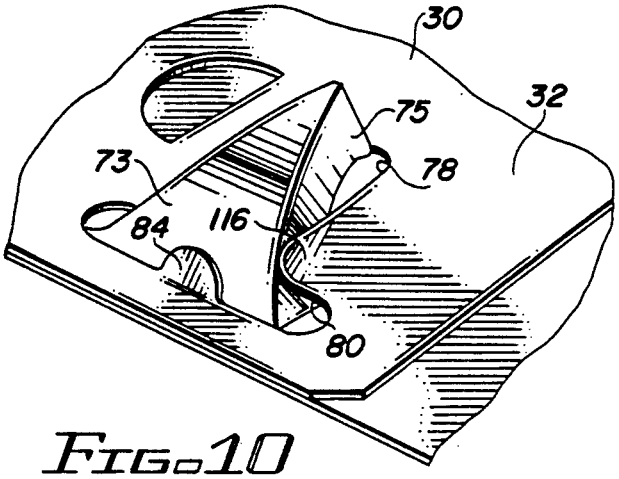
FIG. 10 is a partial pictorial view similar to that of FIG. 9, but showing the retainer flap in fully extended condition.

Continued pivoting movement of the retaining flap about the fold line 56 will continue to fold the side sections 75 of the retaining flap until the retaining flap reaches its fully extended position in the interior of the carrier. This position is illustrated in FIGS. 10, 11 and 12. The movement of the retaining flap has caused the tab 84 to be urged up out of its normal planar alignment with the inner bottom panel flap 30. The tab stabilizes further pivoting movement of the retaining flap and biases the retaining flap toward the adjacent bottles, not shown in FIG. 10 for the sake of clarity. In similar fashion, the tabs 116 formed by the curved edges connecting the slot portions 78 and 80 will have been pushed up out of their normal plane in the bottom panel flap 30, which biases the tabs 116 against the side sections 75 of the retaining flap to help maintain the retainer flap in its fully formed rigid configuration. As best seen in FIG. 12, the edges 118 of the retaining flap sections corresponding to the slit 60 are in contact with each other throughout their lengths.

The preferred arrangement whereby the retaining flap fold line is slightly inwardly curved or bowed also helps to maintain the retaining flap in contact with the adjacent bottles. This is because the slight curvature is sufficient to bias the central section 73 in the direction toward its original position in the plane of the outer bottom panel flap 32. In so doing the central section 73 is biased against the intervening bottles.

The curvature of the retaining flap fold lines 72 is selected to correspond to the curvature of the bottom portions of the bottles to be packaged, causing the side sections 75 of the retaining flaps to conform to the curvature of the bottles. The narrow edge of the retaining flap is a result of the folding of the edges 60 of the retaining flap about the point at which the converging curved fold lines 75 meet, which in turn permits the fully erected retaining flap to extend back between the adjacent bottles to their point of contact. If articles having straight bottom portions are to be packaged instead of bottles, the retaining flap fold lines 72 can be straight but still angled toward each other as in the case of the curved fold lines illustrated.

It can be appreciated that the bottle retaining means of the invention provides an effective retainer which engages substantial portions of the end bottles in a carrier, and does so without adding to the material cost of the carrier blank. In addition, the retaining means provides an additional mechanical lock between the flaps forming the bottom panel, thus further ensuring against the accidental escape of bottles from the carrier through failure of the bottom panel.

Although the mechanical locking means for the bottom panel flaps need not be limited to the type shown, it is preferred because of its proven ability to hold the panel flaps in locked condition against severe stresses and because it is especially suitable for use with the retaining means of the invention. For example, even though the retaining flaps are required to be located at a point in the outer bottom panel flap immediately adjacent the locking margin, by conforming the outer edge of the retaining flap to the shape of primary locking tab 92, both the retaining flap elements and the locking tabs can be properly located with respect to each other.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention, as defined in the appended claims.

What is claimed is:

1. A substantially rectangular blank for forming a wrap-around article carrier having side panels and open ends, comprising:

a top panel section;

side panel sections connected to opposite sides of the top panel section;

an inner bottom panel flap connected to one of the side panel sections and an outer bottom panel flap connected to the other side panel section, the outer bottom panel flap being adapted to overlie the inner bottom panel flap in the bottom panel of a carrier formed from the blank;

the inner bottom panel flap containing an opening adjacent an edge corresponding to an open end of the carrier formed from the blank; and the outer bottom panel flap including integral article retaining means located so as to extend through the opening in the inner bottom panel flap in the carrier formed form the blank to prevent outward movement of the bottom portion of an adjacent article in the carrier;

the article retaining means comprising a retaining flap connected to the outer bottom panel flap along a retaining flap fold line adjacent the edge of the outer bottom panel flap corresponding to said open end of the carrier, the retaining flap fold line extending substantially parallel to said edge.

2. The wrap-around carrier blank of claim 1, wherein the retaining flap contains fold line means extending transversely of the retaining flap fold line.

3. The wrap-around carrier blank of claim 2, wherein at least a portion of the opening in the inner bottom flap extends transversely of the retaining flap fold line substantially centrally of the length of the retaining-flap.

4. The wrap-around carrier blank of claim 3, wherein the opening in the inner bottom panel flap includes a portion substantially coinciding with the retaining flap fold line in a carrier formed from the blank, the retaining flap being adapted to extend through both portions of the opening.

5. The wrap-around carrier blank of claim 4, wherein the transverse fold line means on the retaining flap comprises two fold lines extending away from the retaining flap fold line, the fold lines converging toward each other from spaced points on the retaining flap fold line.

6. The wrap-around carrier blank of claim 5, wherein the transverse fold lines of the retaining flap are curved so that the portions of the retaining flap on either side of the curved fold lines conform to the curvature of curved bottom portions of adjacent articles in a carrier formed from the blank.

7. A wrap-around article carrier, comprising:

a top panel;

opposite side panels connected to the top panel;

a bottom panel comprising inner and outer bottom flaps, each flap having a side edge and end edges, the inner bottom panel flap being connected along the side edge thereof to one of the side panels and the outer bottom panel flap overlying the inner bottom flap and being connected along the side edge thereof to the other side panel;

the inner bottom panel flap containing an opening adjacent one of the end edges thereof; and the outer bottom panel flap including integral article retaining means extending through said opening to prevent outward movement of the bottom portion of an adjacent article;

the article retaining means comprising a retaining flap connected to the outer bottom panel flap along a retaining flap fold line extending substantially parallel to the end edge of the outer bottom panel flap.

8. The wrap-around carrier of claim 7, including interconnected mechanical lock means on the inner and outer bottom flaps for assisting the retaining flap in locking the inner and outer bottom panel flaps together.

9. The wrap-around carrier of claim 7, wherein the carrier includes a retaining flap adjacent each end of the carrier.

10. A wrap-around article carrier, comprising:

a top panel;

opposite side panels connected to the top panel;

a bottom pane comprising an inner bottom panel flap connected to one of the side panels and an outer bottom panel flap overlying the inner bottom flap and being connected to the other side panel;

the inner bottom panel flap containing an opening adjacent an end of the carrier;

the outer bottom panel flap including integral article retaining means extending through said opening to prevent outward movement of the bottom portion of an adjacent article;

the article retaining means comprising a retaining flap connected to the outer bottom panel flap along a retaining flap fold line;

the retaining flap fold line being substantially parallel to the adjacent end of the carrier and slightly curved in a direction toward the interior of the carrier.

11. A wrap-around article carrier, comprising:

a top panel;

opposite side panels connected to the top panel;

a bottom panel comprising an inner bottom panel flap connected to one of the side panels and an outer bottom panel flap overlying the inner bottom flap and being connected to the other side panel;

the inner bottom panel flap containing an opening adjacent an end of the carrier;

the outer bottom panel flap including integral article retaining means extending through said opening to prevent outward movement of the bottom portion of an adjacent article;

the article retaining means comprising a retaining flap connected to the outer bottom panel flap along a retaining flap fold line; and the retaining flap containing fold line means extending transversely of the retaining flap fold line.

12. The wrap-around carrier of claim 11, wherein at least a portion of the opening in the inner bottom flap extends transversely of the retaining flap fold line substantially centrally of the length of the retaining flap.

13. The wrap-around carrier of claim 12, including a tab integrally connected to the inner bottom panel flap adjacent said opening, the tab engaging the retaining flap adjacent the retaining flap fold line.

14. The wrap-around carrier of claim 12, wherein the opening in the inner bottom panel flap includes a portion substantially coinciding with the retaining flap fold line, the retaining flap extending through both portions of the opening.

15. The wrap-around carrier of claim 11, wherein the retaining flap has an end edge opposite the retaining flap fold line, and wherein the transverse fold line means on the retaining flap comprises two fold lines extending from spaced points on the retaining flap fold line and converging toward each other.

16. The wrap-around carrier of claim 15, wherein the portion of the retaining flap between the transverse fold lines faces the adjacent end of the carrier and the portions on either side of the transverse fold lines face the side panels of the carrier.

17. The wrap-around carrier of claim 16, wherein the transverse fold lines of the retaining flap are curved so that the portions of the retaining flap on either side of the curved fold lines conform to the curvature of curved bottom portions of adjacent articles.

* * * * *